US008035660B2

(12) United States Patent
Jeon

(10) Patent No.: US 8,035,660 B2
(45) Date of Patent: Oct. 11, 2011

(54) LIQUID CRYSTAL DISPLAY WITH CORRECTED IMAGE DATA AND METHOD OF DRIVING THE LIQUID CRYSTAL DISPLAY

(75) Inventor: Byung-kil Jeon, Anyang-si (KR)

(73) Assignee: Samsung Electronics Co., Ltd. (KR)

( * ) Notice: Subject to any disclaimer, the term of this patent is extended or adjusted under 35 U.S.C. 154(b) by 1031 days.

(21) Appl. No.: 11/869,541

(22) Filed: Oct. 9, 2007

(65) Prior Publication Data

US 2008/0084432 A1 Apr. 10, 2008

(30) Foreign Application Priority Data

Oct. 9, 2006 (KR) ..... 10-2006-0097962
Feb. 22, 2007 (KR) ..... 10-2007-0018060

(51) Int. Cl.
*G09G 5/10* (2006.01)

(52) U.S. Cl. ..... 345/690

(58) Field of Classification Search ..... 345/89, 345/690

See application file for complete search history.

(56) References Cited

U.S. PATENT DOCUMENTS

| | | | | |
|---|---|---|---|---|
| 5,351,067 | A * | 9/1994 | Lumelsky et al. | 345/561 |
| 2003/0016199 | A1* | 1/2003 | Lee et al. | 345/88 |
| 2004/0252111 | A1* | 12/2004 | Cheon et al. | 345/204 |
| 2006/0050038 | A1* | 3/2006 | Cheon et al. | 345/89 |
| 2006/0087696 | A1* | 4/2006 | Lee | 358/3.13 |
| 2007/0120794 | A1* | 5/2007 | Shin et al. | 345/89 |

FOREIGN PATENT DOCUMENTS

| | | |
|---|---|---|
| JP | 2005-354532 | 12/2005 |
| KR | 1020040072425 | 8/2004 |
| KR | 1020050033297 | 4/2005 |

* cited by examiner

*Primary Examiner* — Richard Hjerpe
*Assistant Examiner* — Andrew Schnirel
(74) *Attorney, Agent, or Firm* — Innovation Counsel LLP

(57) ABSTRACT

A liquid crystal display (LCD) and a method of driving the same are provided. The LCD includes a graphic controller providing raw image data and a conversion data set for correcting the raw image data, a timing controller correcting the input raw image data using the conversion data set and outputting corrected image data, a data driver receiving the corrected image data, selecting a gray scale voltage corresponding to the corrected image data, and outputting the selected gray scale voltage. A liquid crystal panel displays an image according to the level of the gray scale voltage.

21 Claims, 9 Drawing Sheets

LIQUID CRYSTAL DISPLAY WITH CORRECTED IMAGE DATA AND METHOD OF DRIVING THE LIQUID CRYSTAL DISPLAY

CROSS-REFERENCE TO RELATED APPLICATION

This application claims priorities from Korean Patent Application No. 10-2006-0097962 filed on Oct. 9, 2006 and No. 10-2007-0018060 filed on Feb. 22, 2007 in the Korean Intellectual Property Office, the contents of which are incorporated herein by reference in their entirety.

BACKGROUND OF THE INVENTION

1. Field of the Invention

The present invention relates to a liquid crystal display (LCD) and a method of driving the same, and more particularly, to an LCD and a method of driving the same that can improve image display quality.

2. Description of the Related Art

To satisfy ever-increasing demand for large screens, the pace and amount of development for lightweight and slim display devices have increased in the recent years. For example, LCDs having such advantages have been developed and widely commercialized as TV/PC monitors.

In many of these LCD devices, a graphic controller and a timing controller in an LCD TV perform signal processing on image data received from an external source to improve display quality. The signal processing usually includes gamma correction that requires bit expansion. Image data that has been subjected to signal processing by the graphic controller is input to a timing controller and is subjected to further signal processing by the timing controller according to the characteristics of a liquid crystal panel. In this case, there is a limitation on the number of bits in the image data that the timing controller and data driver can process.

That is, when signal processing of the image data increases the number of bits to improve display quality, the resultant image data is subjected to a plurality of dithering processes by the graphic controller and the timing controller to reduce the number of bits in the image data. However, noise is generated during the dithering processes, thus decreasing display quality.

SUMMARY OF THE INVENTION

Exemplary embodiments of the present invention provide a liquid crystal display (LCD) with improved display quality.

Exemplary embodiments of the present invention also provide a method of driving the LCD that can improve display quality.

According to an aspect of the present invention, there is provided an LCD including a graphic controller, a timing controller, a data driver, and a liquid crystal panel. The graphic controller provides raw image data and a conversion data set for correcting the plurality of raw image data, the timing controller corrects the input raw image data using the conversion data set and outputting corrected image data, and the data driver receives the corrected image data, selects a gray scale voltage corresponding to the corrected image data, and outputs the selected gray scale voltage. A liquid crystal panel displaying an image according to the level of the gray scale voltage.

According to another aspect of the present invention, there is provided an LCD including a graphic controller, a timing controller, a data driver, and a liquid crystal panel. The graphic controller provides raw image data and first and second conversion data sets for correcting the raw image data, and the timing controller corrects the raw image data. The timing controller corrects the raw image data by using the first conversion data set, outputting first corrected image data in a current frame, correcting the first corrected image data in the current frame by using the first corrected image data in the previous frame and the second conversion data set, and outputting a second corrected image data. The data driver receives the second corrected image data, selects a gray scale voltage corresponding to the second corrected image data, and outputs the selected gray scale voltage, and the liquid crystal panel displays an image according to the level of the gray scale voltage.

According to yet another aspect of the present invention, there is provided a method of driving an LCD. The method includes providing raw image data and a conversion data set for correcting the raw image data, correcting the raw image data using the conversion data set and outputting corrected image data, selecting a gray scale voltage corresponding to the corrected image data and outputting the selected gray scale voltage, and displaying an image according to the level of the gray scale voltage.

BRIEF DESCRIPTION OF THE DRAWINGS

The above and other aspects and features of the present invention will become more apparent by the detailed descriptions of exemplary embodiments with reference to the attached drawings, in which.

DETAILED DESCRIPTION OF EXEMPLARY EMBODIMENTS

Figure 1:
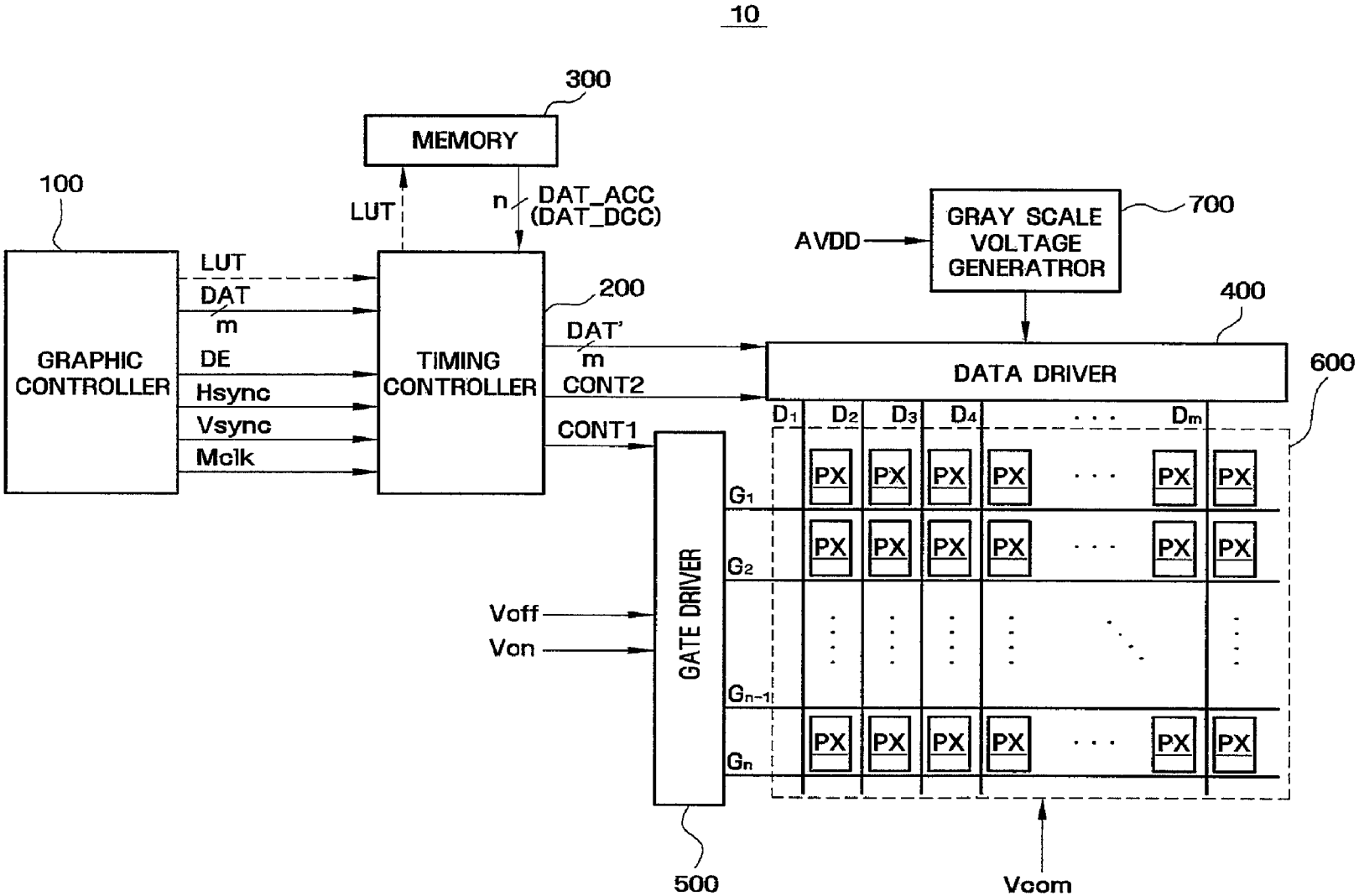
FIG. 1 is a block diagram of a liquid crystal display (LCD) according to an exemplary embodiment of the present invention.

Advantages and features of the present invention and methods of accomplishing the same may be understood more readily by reference to the following detailed description of exemplary embodiments and the accompanying drawings.

The present invention may, however, be embodied in many different forms and should not be construed as being limited to the exemplary embodiments set forth herein. Rather, these exemplary embodiments are provided so that this disclosure will be thorough and complete and will fully convey the concept of the invention to those skilled in the art, and the present invention will only be defined by the appended claims. Like reference numerals refer to like elements throughout the specification. The present invention will now be described more fully with reference to the accompanying drawings, in which exemplary embodiments of the invention are shown.

In the present invention, conversion data set is output from a graphic controller during a frame blank period when no raw image data is being provided. To distinguish between input of the conversion data set and input of the raw image data, a signal representing input of a conversion data set is indicated by a dotted line in the drawings.

FIG. 1 is a block diagram of a liquid crystal display (LCD) 10 according to an exemplary embodiment of the present invention.

Referring to FIG. 1, the LCD 10 includes a graphic controller 100, a timing controller 200, a memory 300, a data driver 400, a gate driver 500, a liquid crystal panel 600, and a gray scale voltage generator 700. For example, the LCD 10 may be an LCD TV.

The graphic controller 100 provides a conversion data set LUT, raw image data DAT, and a plurality of control signals DE, Hsync, Vsync, and Mclk.

The conversion data set LUT includes a plurality of conversion data values DAT_ACC and DAT_DCC corresponding one-to-one with a plurality of raw image data values DAT. The raw image data DAT refers to m-bit red (R), green (G), and blue (B) data. The conversion data DAT_ACC and DAT_DCC may be n-bit data ($n \geqq m$). The conversion data DAT_ACC and DAT_DCC may be data used for gamma correction exemplified by Adaptive Color Correction (ACC) or data used for improving the response speed of liquid crystal using Dynamic Capacitance Compensation (DCC).

The graphic controller 100 outputs the conversion data set LUT for converting the gamma characteristics of the raw image data DAT or improving the response speed of liquid crystal to the timing controller 200 without performing any conversion on the raw image data DAT. The graphic controller 100 may provide the conversion data set LUT to the timing controller 200 during a frame blank period when no raw image data DAT is being provided.

The plurality of control signals DE, Hsync, Vsync, and Mclk include a data enable signal DE that is kept high while the raw image data DAT is output to indicate that the signal output to the timing controller 200 is the raw image data DAT, a vertical synchronization signal Vsync indicating the start of a frame, a horizontal synchronization signal Hsync produced at the beginning of each gate line, and a main clock signal Mclk.

The timing controller 200 corrects the raw image data DAT using the conversion data set LUT and outputs the corrected image data DAT'.

More specifically, the timing controller 200 stores the conversion data set LUT output from the graphic controller 100 during the frame blank period in the memory 300. When m-bit raw image data DAT is input, the timing controller 200 reads n-bit conversion data DAT_ACC and DAT_DCC corresponding to the input raw image data DAT from the conversion data set LUT stored in the memory 300, corrects the raw image data DAT using the conversion data DAT_ACC and DAT_DCC, and outputs m-bit corrected image data DAT' to the data driver 400. In particular, the timing controller 200 modifies the gamma characteristic of the m-bit raw image data DAT ($n>m$) using the n-bit conversion data DAT_ACC and DAT_DCC. That is, the timing controller 200 performs gamma correction through bit expansion and dithering through bit reduction and outputs the m-bit corrected image data DAT'.

The timing controller 200 also outputs a gate control signal CONT1 and a data control signal CONT2 to the gate driver 500 and the data driver 400, respectively.

The gate control signal CONT1 for controlling the operation of the gate driver 500 includes a vertical synchronization start signal STV instructing the start of the operation of the gate driver 500, a gate clock signal for controlling the output time of the gate-on voltage, an output enable signal defining the pulse width of the gate-on signal, and so on.

The data control signal CONT2 for controlling the operation of the data driver 400 includes a horizontal synchronization start signal indicating the start of the operation of the data driver 400, an output instruction signal for controlling the output of the data, and so on.

The data driver 400 receives the data control signal CONT2 and the corrected image data DAT' from the timing controller 200, selects a gray scale voltage corresponding to the corrected image data DAT', and applies the gray scale voltage to the liquid crystal panel 600.

The gate driver 500 sequentially applies an externally input gate-on voltage Von and gate-off voltage Voff to a plurality of gate lines $G_1$ through $G_n$ in response to the gate control signal CONT1 received from the timing controller 200.

The liquid crystal panel 600 includes a plurality of pixels PX formed at areas defined by the plurality of data lines $D_1$ through $D_m$ and the plurality of gate lines $G_1$ through $G_n$.

The gate lines $G_1$ through $G_n$ extend substantially in a row direction parallel to each other, and the data lines $D_1$ through $D_m$ extend substantially in a column direction parallel to each other. The gate lines and data lines, $G_1$ through $G_n$ and $D_1$ through $D_n$, respectively, are substantially perpendicular to each other. A gate signal which is a combination of gate-on/off voltages output from the gate driver 500 is applied to the gate lines $G_1$ through $G_n$ and data voltage output from the data driver 400 is applied to the data lines $D_1$ through $D_m$. Accordingly, as data voltage is applied to each pixel, light having an intensity corresponding to a difference between the data voltage applied to the pixel and the common voltage is transmitted, thereby displaying a predetermined image.

Although not shown in FIG. 1, the gray scale voltage generator 700 includes a plurality of resistors connected in series between a node to which a driving voltage AVDD is applied and ground and divides the driving voltage AVDD to generate a plurality of gray scale voltages. An internal circuit in the gray scale voltage generator 700 may have various other configurations.

The LCD 10 having the above-mentioned configuration can provide an improved display quality. That is, because the timing controller 200 sequentially performs gamma correction through bit expansion and dithering and outputs the corrected image data DAT' to the data driver 400, the LCD 10 of the present invention obtains corrected image data DAT' through a single dithering process, thus reducing noise generation compared to noise generation in a conventional LCD using a plurality of dithering processes.

Hereinafter, LCDs according to exemplary embodiments of the present invention are described in detail with reference to FIGS. 2 through 9.

Figure 2:
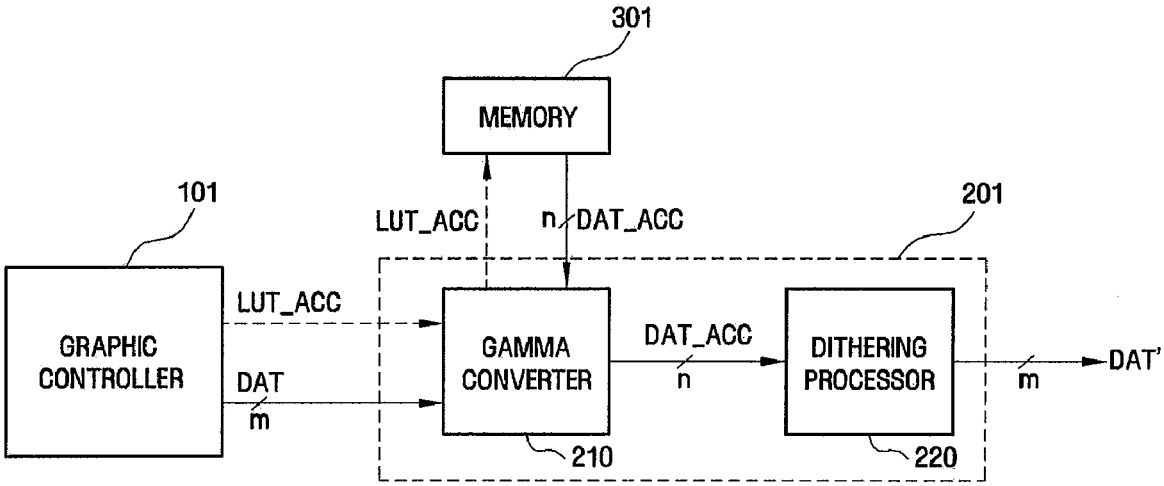
FIG. 2 is a block diagram illustrating a graphic controller and a timing controller of an LCD according to an exemplary embodiment of the present invention.
Figure 3:
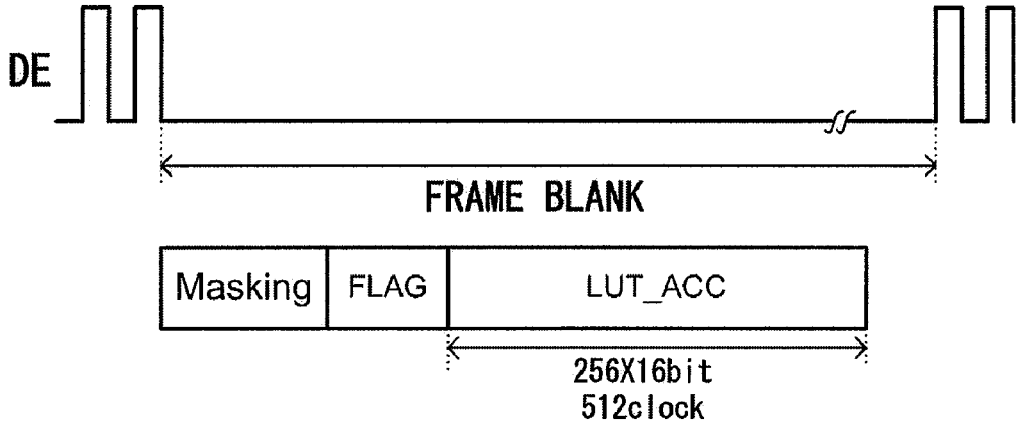
FIG. 3 is a signal diagram illustrating the transmission of a conversion data set shown in FIG. 2.
Figure 4:
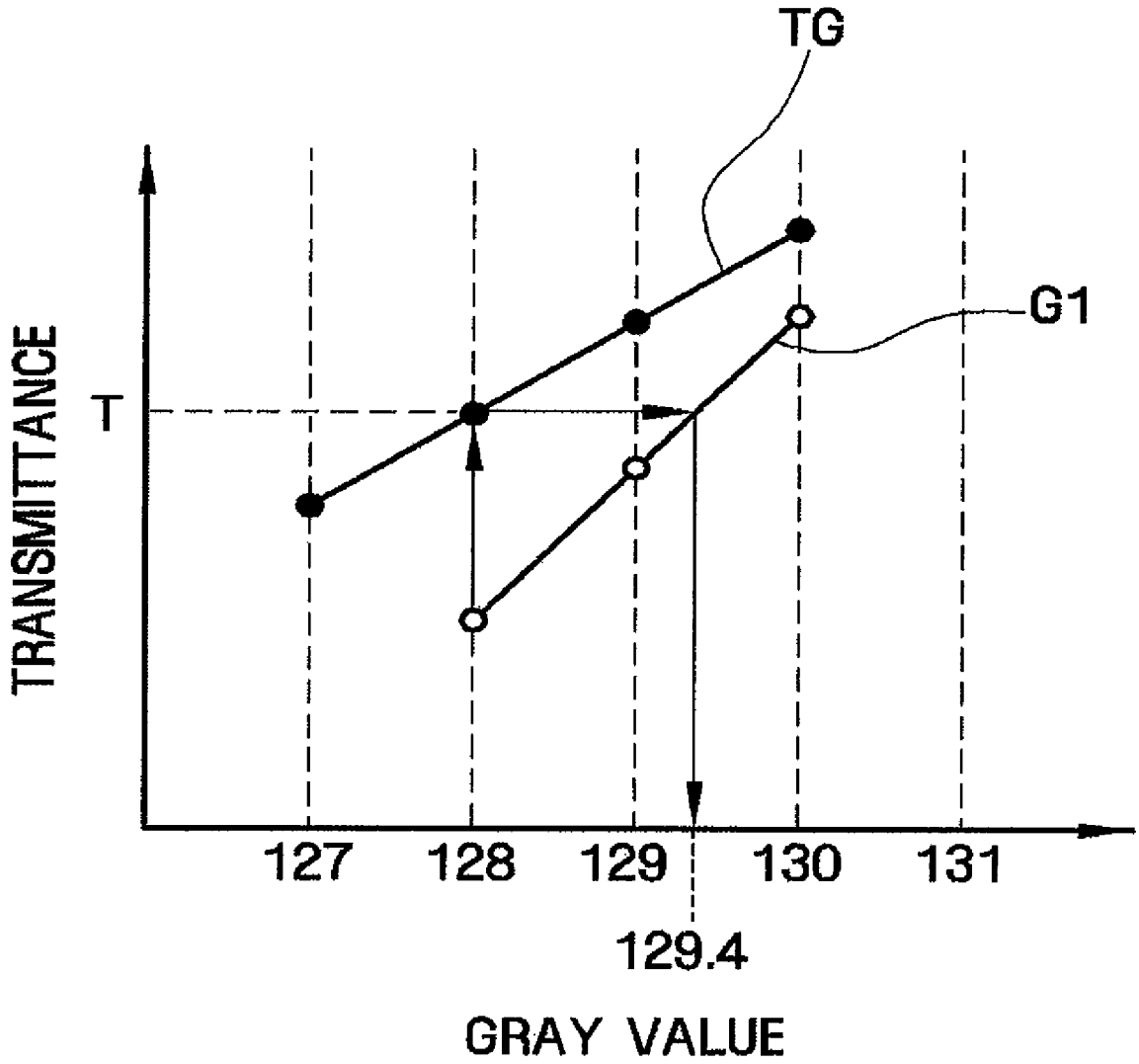
FIG. 4 is a graph illustrating the data conversion process.
Figure 5:
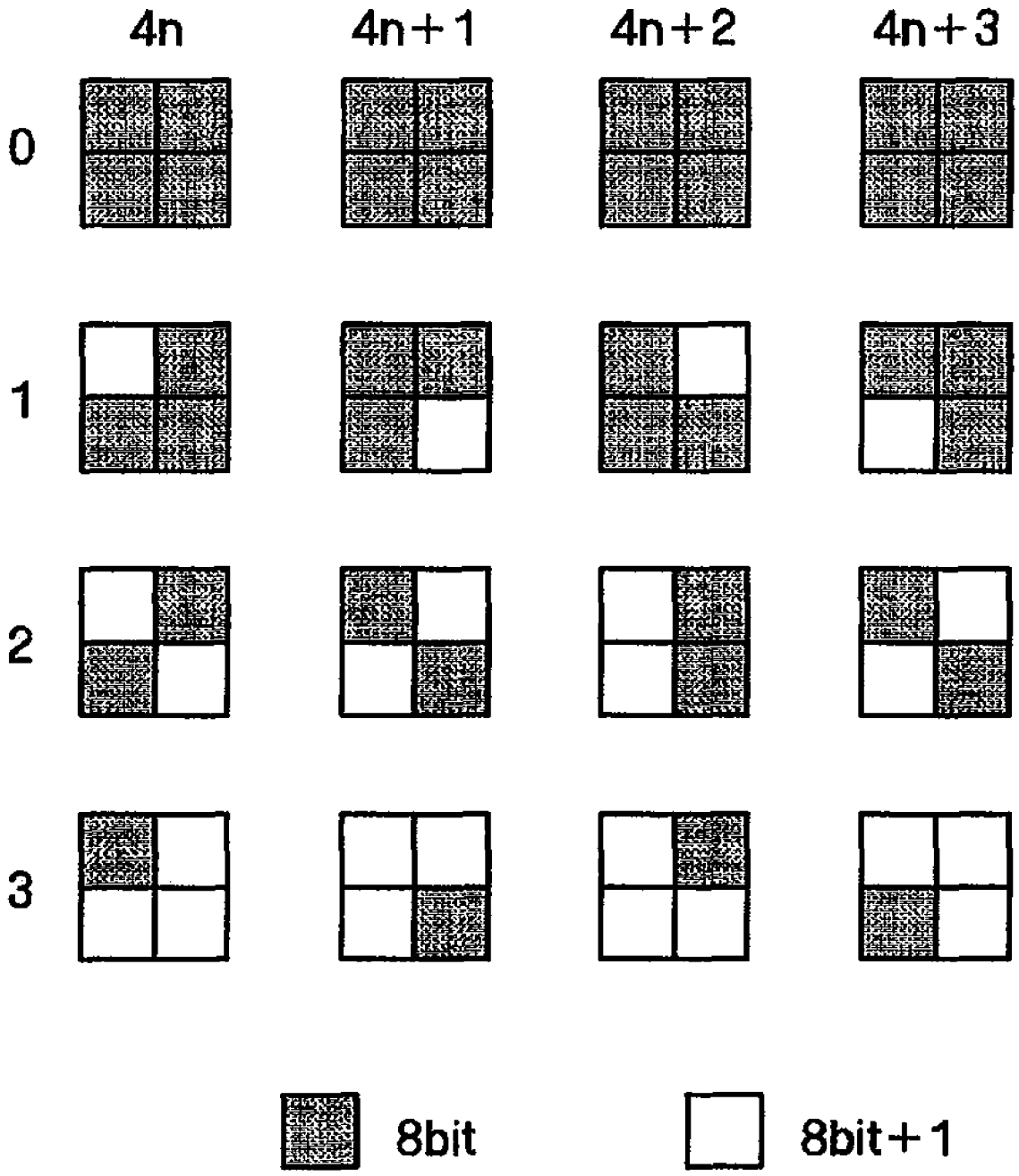
FIG. 5 is a diagram illustrating the dithering process performed by the processor shown in FIG. 2.

First, an LCD according to an exemplary embodiment of the present invention will be described in detail with reference to FIGS. 2 through 5. FIG. 2 is a block diagram illustrating a graphic controller and a timing controller of an LCD according to an exemplary embodiment of the present invention, FIG. 3 is a signal diagram illustrating the transmission of a conversion data set shown in FIG. 2, FIG. 4 is a graph illustrating the data conversion process, and FIG. 5 is a diagram illustrating the dithering process performed by the processor of FIG. 2. For convenience of explanation, various control signals such as data enable signals DE, horizontal synchronization signals Hsync, vertical synchronization signals Vsync, and main clock signals Mclk are omitted in FIG. 2. Although FIG. 2 shows m-bit raw image data and n-bit conversion data ($n \geqq m$), it is assumed hereinafter that m and n are 8 and 10, respectively. Of course, m and n may have other values.

Referring to FIG. 2, a timing controller 201 receives the conversion data set LUT_ACC for converting the gamma characteristics of raw image data DAT from a graphic controller 101 and stores the conversion data set LUT_ACC in the memory 301. The timing controller 201 also receives the raw image data DAT and outputs corrected image data DAT' with changed gamma characteristics.

More specifically, the timing controller 201 includes a gamma converter 210 and a dithering processor 220.

The gamma converter 210 stores the conversion data set LUT_ACC received from the graphic controller 101 in the memory 301.

The transmission of the conversion data set LUT_ACC from the graphic controller 101 will be described in detail with reference to FIG. 3.

Referring to FIG. 3, the conversion data set LUT_ACC is output from the graphic controller 101 during a frame blank period.

More specifically, the graphic controller 101 transmits a bit mask Masking after the frame blank period starts. According to the present exemplary embodiment, the graphic controller 101 informs the timing controller 201 that the conversion data set LUT_ACC has been output by masking a plurality of bits to zero and transmits a flag FLAG. The flag FLAG indicates the characteristics of the conversion data set LUT_ACC such as its type and size. The graphic controller 101 then transmits the conversion data set LUT_ACC consisting of a plurality of conversion data values DAT_ACC to the timing controller 201.

Raw image data DAT corresponds one-to-one with the conversion data values DAT_ACC. Because the raw image data values DAT are 8 bits in size, the conversion data set LUT_ACC includes 256 conversion data values DAT_ACC.

In this case, because the timing controller 201 receives one 8-bit data value per main clock cycle, it can receive one 10-bit conversion data value DAT_ACC after two main clock cycles. That is, the gamma converter 210 receives the conversion data set LUT_ACC containing 256 conversion data values DAT_ACC during 512 main clock cycles. The gamma converter 210 then stores the conversion data set LUT_ACC in the memory 301 in 10-bit units comprising the 10-bit conversion data values DAT_ACC. The conversion data DAT_ACC used for converting the gamma characteristics of the raw image data DAT and corresponding one-to-one with the raw image data DAT will be described in more detail later with reference to FIG. 4.

The graphic controller 101 also provides the raw image data DAT to the timing controller 201 while the data enable signal DE is high.

The gamma converter 210 reads 10-bit conversion data DAT_ACC corresponding to the received raw image data DAT from the memory 301 and transmits the conversion data DAT_ACC to the dithering processor 220. The raw image data DAT may be an address for reading the 10-bit conversion data DAT_ACC from the memory 301.

The dithering processor 220 receives the 10-bit conversion data DAT_ACC and outputs 8-bit corrected image data DAT' to the data driver 400 in FIG. 1 for further processing. The operation of the dithering processor 220 will be described in detail later with reference to FIG. 5.

FIG. 4 is a graph illustrating the data conversion process for using the conversion data DAT_ACC to convert the gamma characteristics of the raw image data DAT. Referring to FIG. 4, a target gamma curve TG and an original gamma curve G1 are expressed in a coordinate plane consisting of x- and y-axes respectively representing gray value and transmittance. The original gamma curve G1 represents transmittance with respect to a gray value of the raw image data DAT. For a given gray value of the raw image data DAT, the target gamma curve TG represents a different transmittance than that of the original gamma curve G1.

When a gray value of input raw image data DAT is 128 and a specific transmittance on the target gamma curve TG corresponding to the gray value of 128 is T, a gray value of the conversion data DAT_ACC corresponding to the specific transmittance T on the original gamma curve G1 is 129.4. That is, the gamma characteristics of the original gamma curve G1 are changed to those of the target gamma curve TG by converting the raw image data DAT having a gray value of 128 into the conversion data DAT_ACC having a gray value of 129.4. Thus, a plurality of conversion data values DAT_ACC correspond one-to-one with a plurality of raw image data values DAT and have different gamma characteristics than the plurality of raw image data values DAT.

Referring back to FIG. 2, upon receiving the conversion data set LUT_ACC including the plurality of conversion data values DAT_ACC from the graphic controller 101, the gamma converter 210 stores the plurality of conversion data values DAT_ACC in the memory 301. When raw image data DAT is input, the gamma converter 210 modifies the gamma characteristics of the raw image data DAT and outputs conversion data DAT_ACC corresponding to the raw image data DAT.

To achieve high precision gamma conversion, a fraction of a gray value is represented by increasing the number of bits. For example, when raw image data DAT having a gray value of 128 is expressed in 8 bits as '10000000', the conversion data DAT_ACC having a gray value of 129.4 may be represented by 10 bits as "1000000101". That is, two bits are added to represent the fraction of the gray value 129.4. While the conversion data DAT_ACC is represented by 10 bits through bit expansion from the 8-bit raw image data DAT in the embodiment, it may be represented using the same number of bits as the raw image data DAT or more than 10 bits in other embodiments.

The operation of the dithering processor 220 in FIG. 2 for converting 10-bit conversion data DAT_ACC into 8-bit corrected image data DAT' is described as follows with reference to FIG. 5.

The 10-bit conversion data DAT_ACC is divided into an upper 8 bits of data and a lower 2 bits of data. The lower 2 bits are '00', '01', '10', or '11'. When the lower 2 bits are '00', four neighboring pixels are all represented by upper 8 bits of data. When the lower 2 bits are '01', three of the four neighboring pixels are each represented by the upper 8 bits of data and the remaining pixel is represented by data in which 1 is added to the upper 8 bits of data. In this case, the lower 2 bits of the four neighboring pixels are '01' on the average. In order to prevent image flickering, the location of a pixel represented by the data in which 1 is added to the upper 8 bits of data is moved over a series of frames, as illustrated in FIG. 5.

Similarly, when the lower 2 bits are '10', two of the four neighboring pixels are expressed using the upper 8 bits of data and the remaining two pixels are expressed using data in which one is added to the upper 8 bits of data. When the lower 2 bits are '11', one of the four neighboring pixels is represented by the upper 8 bits of data and the remaining three pixels are represented by the data in which 1 is added to the upper 8 bits of data. The location of a pixel represented by the data in which 1 is added to the upper 8 bits of data is moved over a series of frames. For instance, as illustrated in FIG. 5, pixel locations are changed with respect to four consecutive frames 4*n*, 4*n*+1, 4*n*+2, and 4*n*+3.

Figure 6:
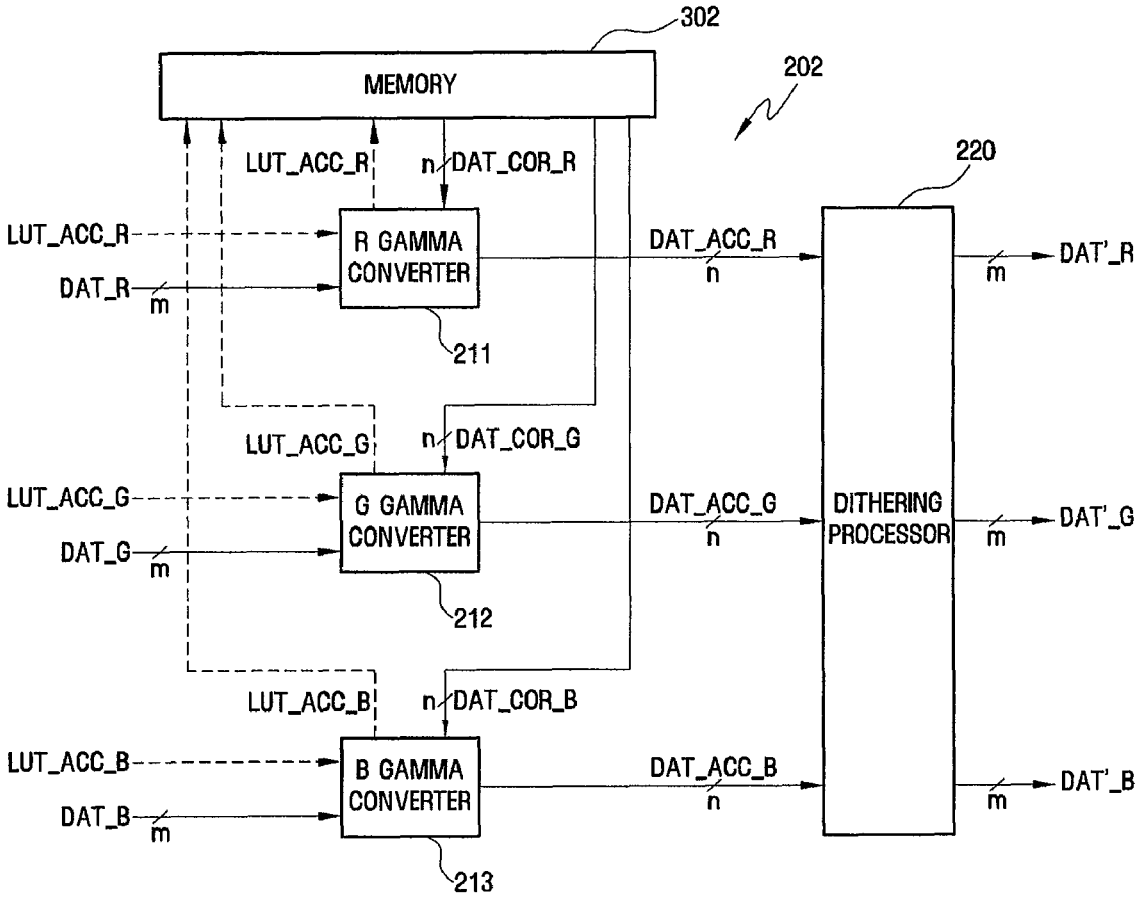
FIG. 6 is a block diagram illustrating a graphic controller and a timing controller in an LCD according to another exemplary embodiment of the present invention.
Figure 7:
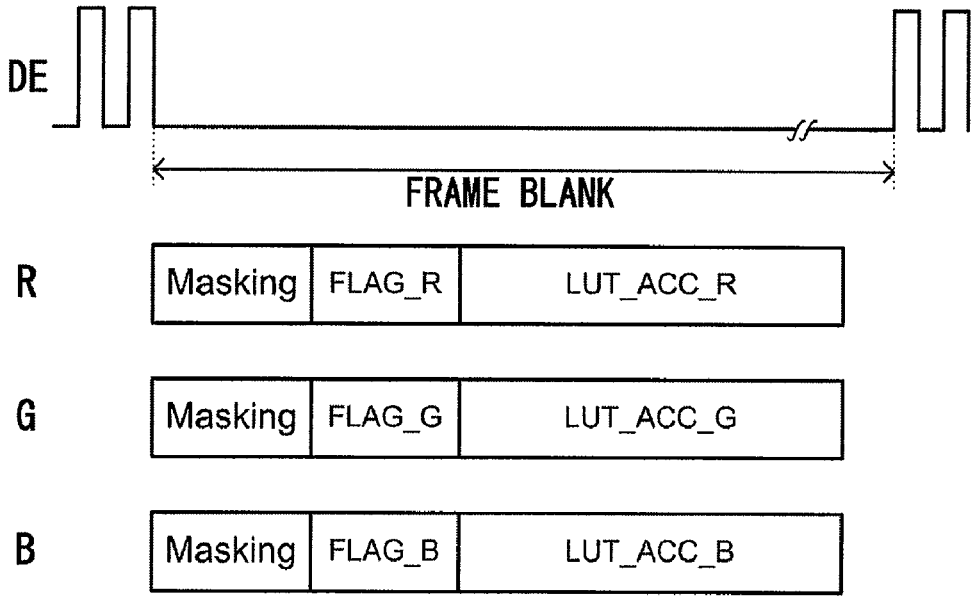
FIG. 7 is a signal diagram illustrating the transmission of a conversion data set.

An LCD according to another exemplary embodiment of the present invention will now be described in detail with reference to FIGS. 6 and 7. FIG. 6 is a block diagram illustrating a graphic controller and a timing controller in an LCD according to another exemplary embodiment of the present invention, and FIG. 7 is a signal diagram illustrating the transmission of a conversion data set. For brevity of description, components each having the same function as in the exemplary embodiments of FIGS. 2 and 3 are identified by the same reference numerals, and repetition of their description will be omitted.

Referring to FIGS. 6 and 7, a graphic controller (not shown) provides a red (R) conversion data set LUT_ACC_R, a green (G) conversion data set LUT_ACC_G, and a blue (B) conversion data set LUT_ACC_B respectively corresponding to R, G, and B raw image data values DAT_R, DAT_B, and DAT_B to a timing controller 202 during a frame blank period. The R, G, and B conversion data sets LUT_ACC_R, LUT_ACC_G, and LUT_ACC_B respectively include a plurality of R, G, and B conversion data values corresponding one to one with a plurality of R, G, and B raw image data values DAT_R, DAT_B, and DAT_B.

The timing controller 202 includes R, G, and B gamma converters 211 through 213 that respectively receive R, G, and B conversion data sets LUT_ACC_R, LUT_ACC_G, and LUT_ACC_B and store them in a memory 302. Flags FLAG_R, FLAG_G, and FLAG_B allow each of the R, G, and B gamma converters 211 through 213 to select one of the conversion data sets LUT_ACC_R, LUT_ACC_G, and LUT_ACC_B since the sequentially input conversion data sets LUT_ACC_R, LUT_ACC_G, and LUT_ACC_B identify the conversion data sets LUT_ACC_R, LUT_ACC_G, and LUT_ACC_B.

Thereafter, when the R, G, and B raw image data DAT_R, DAT_G, and DAT_B are input, the R, G, and B gamma converters 211 through 213 respectively read out R, G, and B conversion data DAT_ACC_R, DAT_ACC_G, and DAT_ACC_B corresponding to R, G, and B raw image data and transmit the same to a dithering processor 220.

The dithering processor 220 performs dithering on R, G, and B conversion data DAT_ACC_R, DAT_ACC_G, and DAT_ACC_B and outputs 8-bit R, G, and B corrected image data DAT'_R, DAT'_G, and DAT'_B.

The LCD according to the present exemplary embodiment allows separate gamma conversion for each of the R, G, and B raw image data values DAT_R, DAT_B, and DAT_B, thus providing improved display quality.

Figure 8:
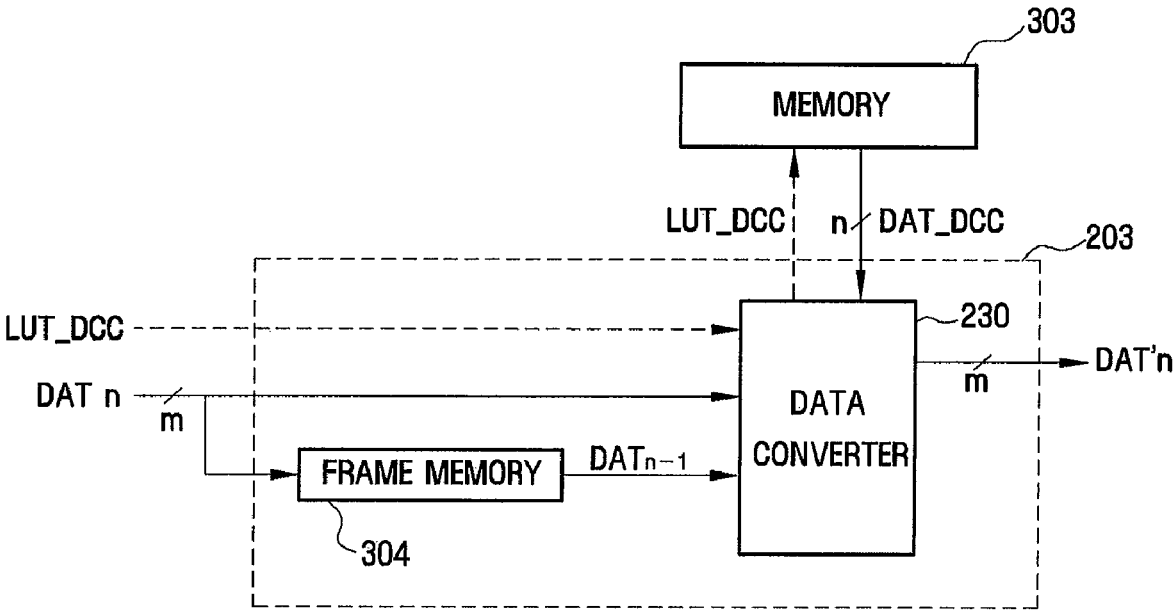
FIG. 8 is a block diagram of a timing controller in an LCD according to another exemplary embodiment of the present invention.
Figure 9:
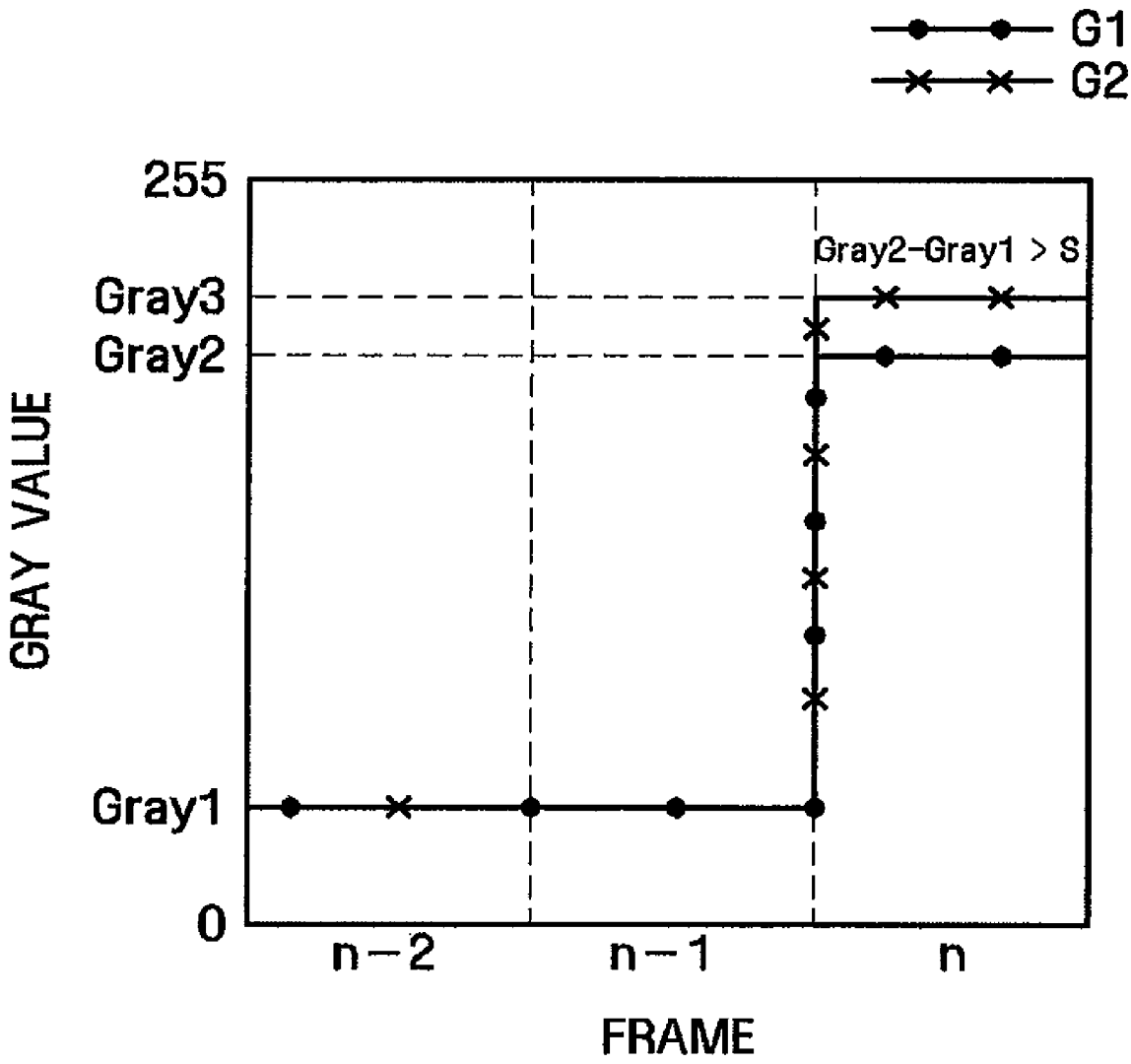
FIG. 9 is a graph illustrating the operation of a data converter shown in FIG. 8.

An LCD according to another exemplary embodiment of the present invention will now be described in detail with reference to FIGS. 8 and 9. FIG. 8 is a block diagram of a timing controller in an LCD according to another exemplary embodiment of the present invention, and FIG. 9 is a graph illustrating the operation of a data converter shown in FIG. 8. Although FIG. 8 indicates that raw image data and conversion data are m and n bits in size, respectively ($n \geqq m$), it is assumed hereinafter that the raw image data and the conversion data are 8 bits. Of course, the raw image data and the conversion data may be less than or more than 8 bits.

Referring to FIG. 8, a timing controller 203 receives a conversion data set LUT_DCC and stores the same in a memory 303. To achieve the functions, the timing controller 203 includes a frame memory 304 and a data converter 230 that uses raw image data DATn of an n-th frame, raw image data DATn−1 of an n−1-th (previous) frame, and conversion data DAT_DCC and outputs corrected image data DAT'n. More specifically, the graphic controller provides a conversion data set LUT_DCC for improving the response speed of liquid crystal to the timing controller 203 during a frame blank period.

The data converter 230 stores the received conversion data set LUT_DCC in the memory 303, and receives the raw image data DATn and DATn−1 of the n-th and n−1-th frames. The frame memory 304 stores the raw image data DATn−1 and transmits the same to the data converter 230 after one frame delay.

The data converter 230 reads conversion data DAT_DCC corresponding to a pair of raw image data values DATn−1 and DATn of the n−1-th and n-th frames from the memory 303, corrects the raw image data DATn of the n-th frame and outputs the corrected image data DAT'n.

The conversion data DAT_DCC corresponding to the pair of raw image data DATn−1 and DATn of the n−1-th and n-th frames exists when a difference between gray values of the raw image data DATn−1 and DATn is greater than a predetermined threshold.

Referring to FIGS. 8 and 9, the x- and y-axes of the graph denote frame and gray values, respectively. A first curve G1 indicates the gray values of raw image data DATn−1 and DATn corresponding to the n−1-th and n-th frames input to the data converter 230. A second curve G2 indicates the gray values of corrected image data DAT'n output by the data converter 230. When a difference between gray values of the raw image data DATn−1 and DATn of the n−1-th and n-th frames is greater than a predetermined threshold (i.e., Gray2−Gray1>S), the data converter 230 corrects the raw image data DATn of the n-th frame and outputs corrected image data DAT'n having a gray value Gray 3 that is greater than the gray of the raw image data DATn of the n-th frame.

In this case, the corrected image data DAT'n may be the same as the conversion data DAT_DCC. That is, the data converter 230 reads conversion data DAT_DCC having a gray value Gray3, corresponding to the pair of raw image data values DATn−1 and DATn of the n−1-th and n-th frames, from the memory 303 and outputs the conversion data DAT_DCC as the corrected image data DAT'n. Thus, the conversion data set LUT_DCC includes conversion data DAT_DCC corresponding to the pair of raw image data values DATn−1 and DATn of the n−1-th and n-th frames only when the difference between gray values of the raw image data DATn−1 and DATn is greater than the predetermined threshold (S). However, the conversion data DAT_DCC may correspond to the pair of raw image data values DATn−1 and DATn in other ways.

When the corrected image data DAT'n having the gray value Gray 3 that is greater than the gray of the raw image data DATn is then applied to the liquid crystal panel 600 in FIG. 1, liquid crystal molecules can be tilted at high speed. That is, by improving the response speed of liquid crystals in this way, the display quality of the LCD 10 in FIG. 1 can be improved. While FIG. 9 shows an exemplary method of data conversion for improving the response time of liquid crystal, data conversion can be performed in other ways.

An LCD according to another exemplary embodiment of the present invention will now be described with reference to FIGS. 10 and 11.

Figure 10:
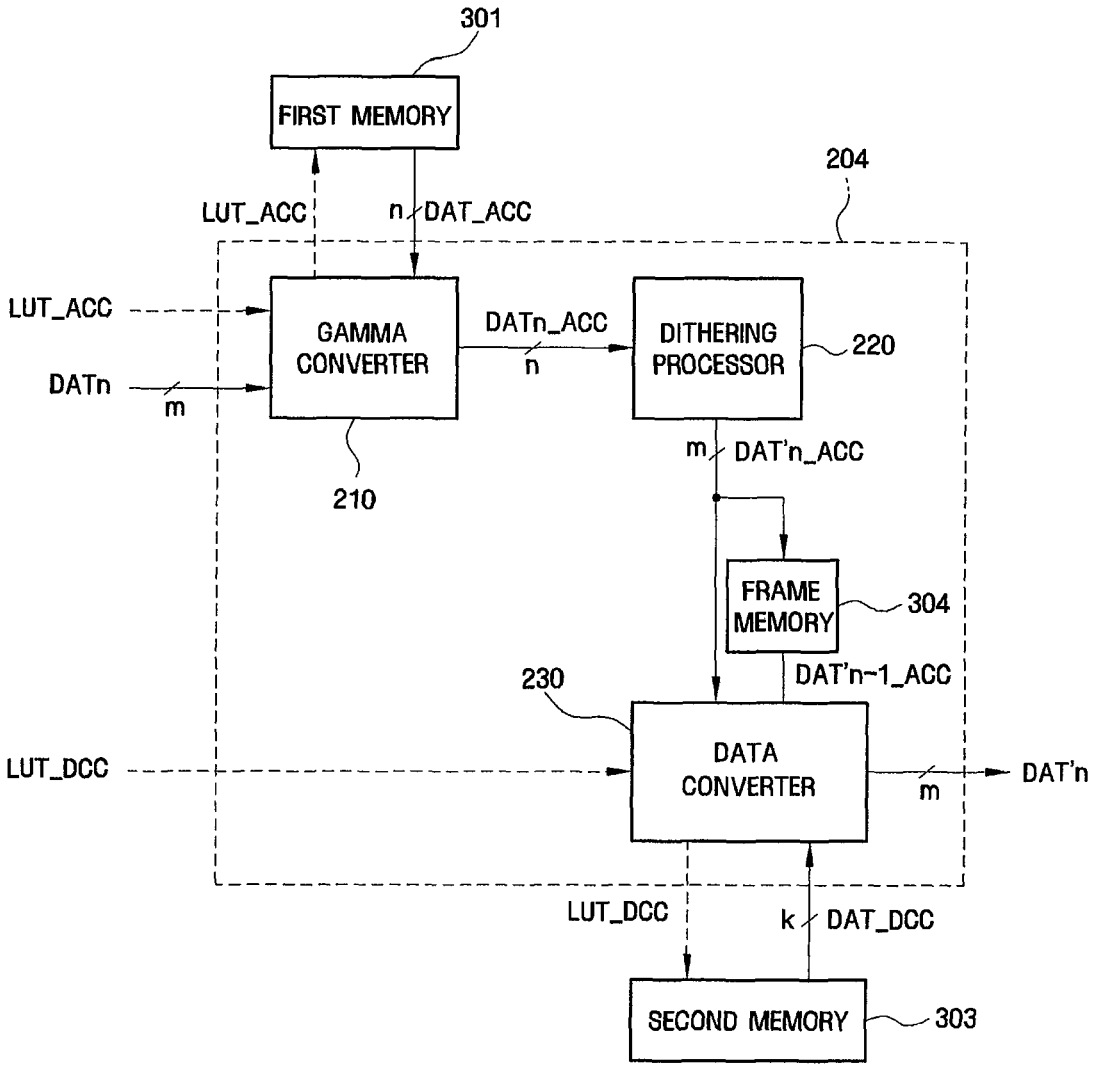
FIG. 10 is a block diagram of an LCD according to another exemplary embodiment of the present invention.
Figure 11:
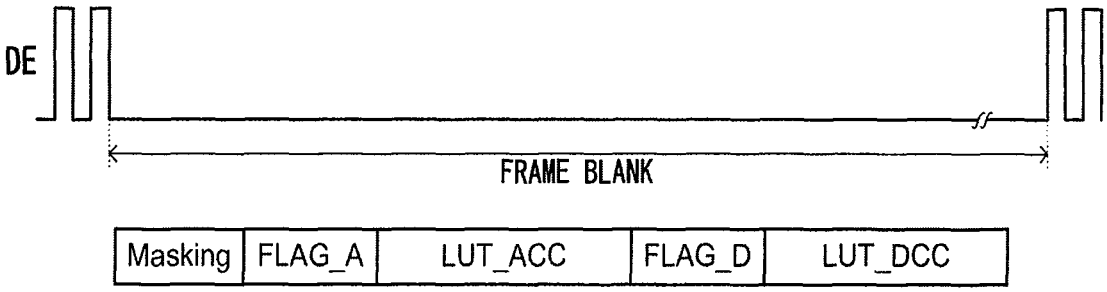
FIG. 11 is a signal diagram illustrating the transmission of a conversion data set.

FIG. 10 is a block diagram of an LCD according to another exemplary embodiment of the present invention, and FIG. 11 is a signal diagram illustrating the transmission of a conversion data set. For brevity of description, components having the same function as in the exemplary embodiments described in FIGS. 2, 3 and 8 are respectively identified by the same reference numerals, and repetition of their description will be omitted.

While FIG. 10 shows that raw image data, first conversion data, and second conversion data are m bits, n bits, and k bits, respectively ($n \geqq m$), it is assumed hereinafter that m, n, and k are 8, 10, and 8, respectively. However m, n, and k may have different values in other embodiments.

Referring to FIGS. 10 and 11, a graphic controller (not shown) provides first and second conversion data sets LUT_ACC and LUT_DCC to a timing controller 204 during a frame blank period. The timing controller 204 respectively stores the received first and second conversion data sets LUT_ACC and LUT_DCC in first and second memories 301 and 303, receives raw image data DATn, and outputs corrected image data DAT'n−1.

More specifically, the graphic controller provides to the timing controller 204 the first conversion data set LUT_ACC for gamma correction and the second conversion data LUT_DCC for improving the response speed of liquid crystal.

Transmission of the first and second conversion data sets LUT_ACC and LUT_DCC will now be described in more detail with reference to FIG. 11. The graphic controller sequentially transmits a bit mask Masking and a first flag FLAG_A to inform the timing controller 204 that the first conversion data set LUT_ACC for gamma conversion is output. After providing the first conversion data set LUT_ACC to the timing controller 204, the graphic controller transmits a second flag FLAG_D to inform the timing controller 204 that the second conversion data set LUT_DCC for improving the response time of liquid crystal is output. The graphic controller then provides the second conversion data set LUT_DCC to the timing controller 204.

The timing controller 204 includes a gamma converter 210, a dithering processor 220, a frame memory 304, and a data converter 230.

The first and second flags FLAG_A and FLAG_D allow the gamma converter 210 and the data converter 230 to selectively receive one of the first and second conversion data sets LUT_ACC and LUT_DCC provided by the graphic controller during a frame blank period. The gamma converter 210 and the data converter 230 respectively store the first and second conversion data sets LUT_ACC and LUT_DCC in the first and second memories 301 and 303.

Upon receiving 8-bit raw image data DATn, the gamma converter 210 first reads first 10-bit conversion data DATn_ACC corresponding to the raw image data DATn and then transmits the first conversion data DATn_ACC to the dithering processor 220.

The dithering processor 220 converts the first 10-bit conversion data DATn_ACC into first 8-bit corrected image data DAT'n_ACC and transmits the first 8-bit corrected image data DAT'n_ACC to the frame memory 304 and the data converter 230.

The frame memory 304 transmits the first 8-bit corrected image data DAT'n_ACC to the data converter 230 after one frame delay.

The data converter 230 receives the first corrected image data DAT'n_ACC as well as first corrected image data DAT'n−1_ACC for an n−1-th (previous) frame to read second conversion data DAT_DCC corresponding to a pair of first corrected image data values DAT'n_ACC and DAT'n−1_ACC for n-th and n−1-th frames from the second memory 303. The data converter 230 then uses the second conversion data DAT_DCC to convert the first corrected image data DAT'n_ACC for the n-th frame into second corrected image data DAT'n for the n-th frame.

The LCD having the above-mentioned configuration allows correction of raw image data DATn using the conversion data sets provided by the graphic controller, thus providing increased display quality. That is, the LCD of the present exemplary embodiment obtains the corrected image data using a single dithering process, thus reducing noise generated due to a multiple dithering process. The LCD also allows update of conversion data sets LUT_ACC and LUT_DCC provided during a frame blank period for every frame, thus achieving optimal image quality.

Figure 12:
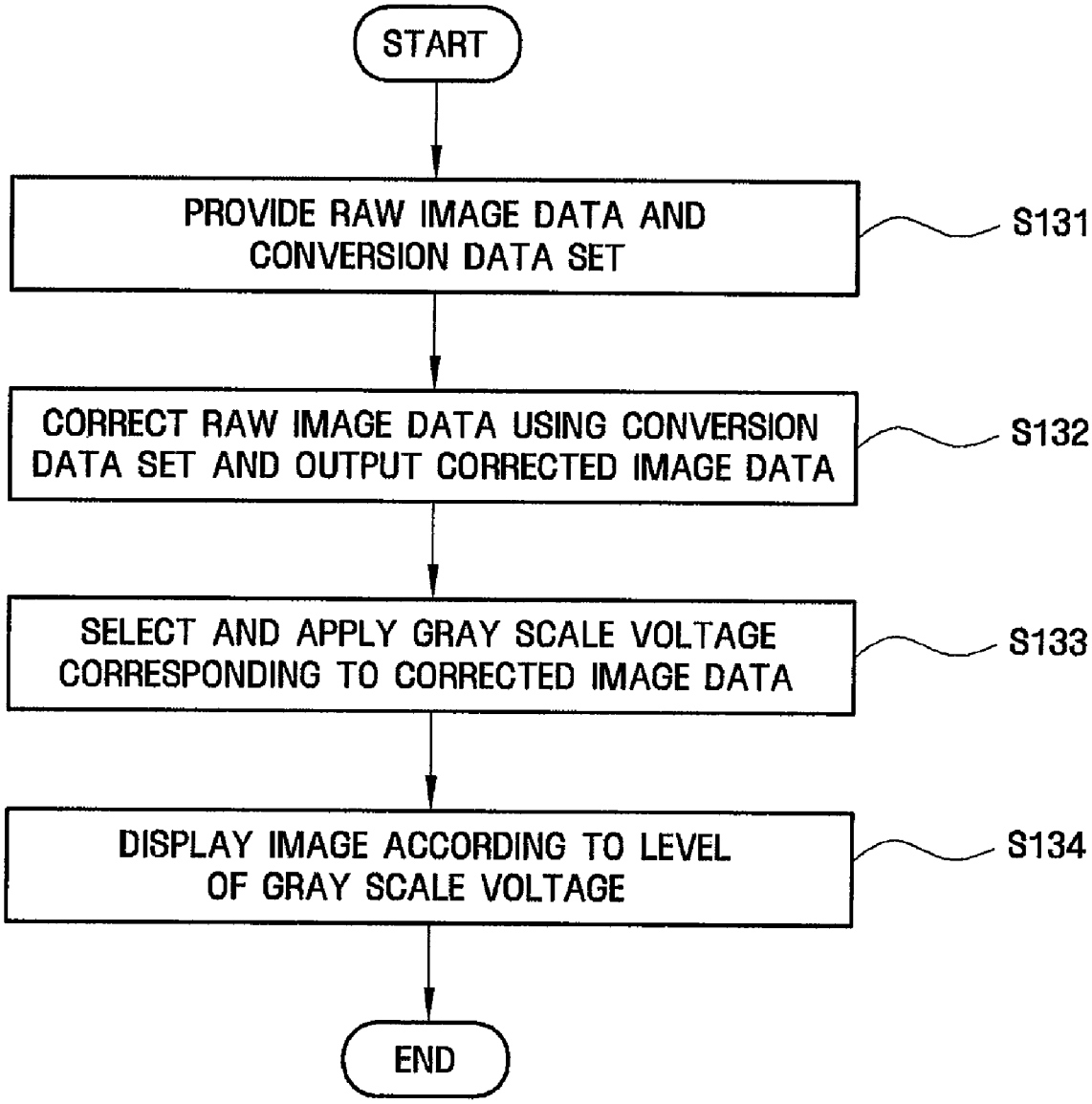
FIG. 12 is a flowchart illustrating a method of driving an LCD according to an exemplary embodiment of the present invention.

A method of driving an LCD according to an exemplary embodiment of the present invention will now be described in detail with reference to FIG. 12. FIG. 12 is a flowchart illustrating a method of driving an LCD according to an exemplary embodiment of the present invention.

Referring to FIG. 12, in step S131, raw image data and a conversion data set are provided.

The conversion data set is provided for converting the gamma characteristics of the raw image data DAT or improving the response speed of liquid crystal. Alternatively, the conversion data set may include first and second conversion data sets for achieving both goals. The conversion data set may be provided during a frame blank period during when no raw image data is being provided. More specifically, after the start of the frame blank period, bits are masked to zero and a flag indicating the characteristics of the conversion data set is sent, followed by transmission of the conversion data set.

Thereafter, in step S132, the conversion data set is used to correct the raw image data and corrected image data is output.

The conversion data set may include n-bit corrected image data corresponding to m-bit raw image data ($n \geqq m$), which is used to correct the m-bit raw image data into m-bit corrected image data.

Then, in step S134, a gray scale voltage corresponding to the corrected image data is selected and applied to the liquid crystal panel 600 in FIG. 1.

An image is displayed according to the level of the gray scale voltage.

An LCD and a method of driving the same according to the present invention have reduced noise relative to the noise in a multiple dithering process, due to use of a single dithering process.

The present invention also allows update of a conversion data set for each frame, thus providing an optimal quality image.

Although the present invention has been described in connection with the exemplary embodiments of the present invention, it will be apparent to those skilled in the art that various modifications and changes may be made thereto without departing from the scope and spirit of the invention. Therefore, it should be understood that the above exemplary embodiments are not exhaustive but illustrative in all aspects.

What is claimed is:

1. A liquid crystal display (LCD) comprising:

a graphic controller providing raw image data and a conversion data set for correcting the raw image data, the raw image data including a plurality of raw image data values and the conversion data set including a plurality of conversion data values;

a timing controller correcting the raw image data using the conversion data set and outputting corrected image data;

a data driver receiving the corrected image data, selecting a gray scale voltage corresponding to the corrected image data, and outputting the gray scale voltage; and a liquid crystal panel displaying an image according to a level of the gray scale voltage;

wherein the graphical controller transmits at least one of a bit mask and a flag after a frame blank period starts, the bit mask masking a plurality of bits, the flag indicating characteristics of the conversion data set, no raw image data being output during the frame blank period.

2. The LCD of claim 1, wherein the plurality of conversion data values corresponds one-to-one with the plurality of raw image data values, the raw image data includes m-bit data, the conversion data set includes n-bit conversion data, and $n \geqq m$.

3. The LCD of claim 2, wherein the conversion data set has a different gamma characteristic than the raw image data.

4. The LCD of claim 2, wherein an original gamma curve and a target gamma curve represent different transmittances at a given gray value of the raw image data, and wherein a gray value of the conversion data set is determined as a gray value corresponding to a specific transmittance on the original gamma curve, the specific transmittance being a transmittance on the target gamma curve corresponding to the gray value of the raw image data.

5. The LCD of claim 4, wherein the timing controller comprises:

a gamma converter receiving the raw image data and outputting the n-bit conversion data by using the conversion data set corresponding to the raw image data; and a dithering processor receiving the n-bit conversion data and outputting m-bit corrected image data.

6. The LCD of claim 1, wherein the graphic controller provides the conversion data set to the timing controller during the frame blank period when no raw image data is output.

7. The LCD of claim 1, wherein the graphic controller sequentially transmits the bit mask, the flag indicating the characteristics of the conversion data set, and the conversion data set after the frame blank period starts.

8. The LCD of claim 1, wherein the graphic controller masks the plurality of bits and transmits the flag before providing the conversion data set to the timing controller.

9. The LCD of claim 1, wherein the graphic controller masks the plurality of bits before transmitting the flag to the timing controller.

10. The LCD of claim 1, wherein the graphic controller informs the timing controller that the conversion data set has been output by masking the plurality of bits.

11. The LCD of claim 1, wherein the conversion data set includes data for improving a response speed of liquid crystals.

12. The LCD of claim 1, wherein the conversion data set includes data for improving a response speed of liquid crystals using dynamic capacitance compensation.

13. A liquid crystal display (LCD) comprising:

a graphic controller providing raw image data and a conversion data set for correcting the raw image data, the raw image data including a plurality of raw image data values and the conversion data set including a plurality of conversion data values;

a timing controller correcting the raw image data using the conversion data set and outputting corrected image data;

a data driver receiving the corrected image data, selecting a gray scale voltage corresponding to the corrected image data, and outputting the gray scale voltage; and a liquid crystal panel displaying an image according to a level of the gray scale voltage, wherein the graphic controller provides the conversion data set during a frame blank period when no raw image data is output, and the graphic controller sequentially transmits a bit mask, a flag indicating characteristics of the conversion data set, and the conversion data set after the frame blank period starts.

14. A method of driving a liquid crystal display (LCD), the method comprising:

providing raw image data values and a conversion data set for correcting the plurality of raw image data values, the raw image data including raw image data values and the conversion data set including conversion data values;

transmitting at least one of a bit mask and a flag after a frame blank period starts, the bit mask masking a plurality of bits, the flag indicating characteristics of the conversion data set, no raw image data being output during the frame blank period;

correcting the raw image data using the conversion data set and outputting corrected image data;

selecting a gray scale voltage corresponding to the corrected image data and outputting the selected gray scale voltage; and displaying an image according to the level of the gray scale voltage.

15. The method of claim 14, wherein the conversion data values correspond one-to-one with the raw image data values, the raw image data includes m-bit data, the conversion data set includes n-bit conversion data, and $n \geqq m$.

16. The method of claim 14, wherein the conversion data set is provided during the frame blank period.

17. The method of claim 14 comprising:

masking the plurality of bits to zero after the frame blank period starts;

and sequentially transmitting flags indicating statuses of the conversion data set and a second conversion data set.

18. The method of claim 14, wherein the masking the plurality of bits and transmitting the flag are performed before transmitting the conversion data set for use in the correcting.

19. The method of claim 14, wherein the masking the plurality of bits is performed before the transmitting of the flag.

20. The method of claim 14, wherein the characteristics of the conversion data including at least one of a type of the conversion data and a size of the conversion data.

21. The method of claim 14, wherein the characteristics of the conversion data including a type of the conversion data and a size of the conversion data.

* * * * *